US007422025B1

(12) United States Patent
Waldstreicher et al.

(10) Patent No.: US 7,422,025 B1
(45) Date of Patent: Sep. 9, 2008

(54) WALKER DEVICE WITH ARM AND HAND SUPPORT

(76) Inventors: Barbara Waldstreicher, 15278 Laverne Dr., San Leandro, CA (US) 94579; Claudia Gronley Wittebort, 250 St. Nicholas Ct., Fremont, CA (US) 94539

( * ) Notice: Subject to any disclaimer, the term of this patent is extended or adjusted under 35 U.S.C. 154(b) by 0 days.

(21) Appl. No.: 11/188,354

(22) Filed: Jul. 25, 2005

(51) Int. Cl.
*A61H 3/02* (2006.01)

(52) U.S. Cl. ..... 135/71; 135/72; 135/73

(58) Field of Classification Search ..... 135/71, 135/67, 68, 72, 66
See application file for complete search history.

(56) References Cited

U.S. PATENT DOCUMENTS

| | | | | | |
|---|---|---|---|---|---|
| 2,362,466 | A | * | 11/1944 | Carter | 297/6 |
| 2,811,978 | A | * | 11/1957 | Russell | 135/65 |
| D181,957 | S | | 1/1958 | Callahan | |
| 3,195,550 | A | | 7/1965 | Ingalls et al. | |
| 3,596,298 | A | * | 8/1971 | Durst, Jr. | 5/87.1 |
| 3,625,237 | A | | 12/1971 | Wertz | |
| 4,151,853 | A | * | 5/1979 | Inbar | 135/71 |
| 4,748,994 | A | | 6/1988 | Schultz et al. | |
| 5,038,811 | A | * | 8/1991 | Gilmore | 135/71 |
| 5,329,954 | A | * | 7/1994 | Miyoshi | 135/71 |
| 5,538,268 | A | * | 7/1996 | Miller | 280/87.05 |
| 5,605,169 | A | * | 2/1997 | Light | 135/66 |
| 5,657,783 | A | | 8/1997 | Sisko et al. | |
| 5,771,910 | A | * | 6/1998 | Kluttz | 135/68 |
| 6,082,384 | A | | 7/2000 | Cheng | |
| 6,164,305 | A | * | 12/2000 | Herman | 135/68 |
| 6,279,591 | B1 | | 8/2001 | Obitts | |
| 6,386,588 | B1 | * | 5/2002 | Young et al. | 280/821 |
| 6,470,900 | B1 | | 10/2002 | Hamilton | |
| 7,111,856 | B1 | * | 9/2006 | Graham | 280/87.021 |

* cited by examiner

*Primary Examiner*—David R Dunn
*Assistant Examiner*—Noah Chandler Hawk
(74) *Attorney, Agent, or Firm*—Thomas R. Lampe

(57) ABSTRACT

A support is connected to a walker frame, the support including an elongated member pivotally mounted on the walker frame and a forearm cuff member angularly and linearly adjustable relative to the elongated member. The support limits sideways movement of the user's forearm while maintaining it in a generally vertical orientation so that body weight can be applied downwardly through the forearm and hand to the walker frame.

3 Claims, 2 Drawing Sheets

WALKER DEVICE WITH ARM AND HAND SUPPORT

TECHNICAL FIELD

This invention relates to a walker device and more particularly to a walker device incorporating support structure for aligning and stabilizing a user's weak or immobilized arm. The support allows the patient to place weight onto his or her weaker arm, facilitating and stimulating muscle return and muscle re-education, as well as providing other advantages.

BACKGROUND OF THE INVENTION

Walkers are well known structures for assisting physically challenged individuals when walking. It is also well known to incorporate with walker devices specialized types of support structures for attaining desired end results.

It is known, for example, to provide arm supports for use by individuals utilizing walkers. U.S. Pat. No. 3,625,237 shows an arm support for an invalid using a walker which supports a forearm in a horizontal orientation. U.S. Pat. No. 5,657,783 discloses spaced, horizontally disposed forearm rests located generally above walker device hand-grips engageable with the user's outwardly flexed forearms while the user is grasping the hand-grips. U.S. Pat. No. 4,248,246 discloses a platform crutch attachment for an invalid walker having a generally horizontally disposed arm support at the top of the crutch. U.S. Pat. No. 6,279,591 also discloses an arm support which is essentially maintained in a horizontal orientation. A walking aid is disclosed in U.S. Pat. No. 4,748,994 incorporating a horizontally disposed forearm rest. U.S. Pat. No. 6,082,384 discloses a hand support for a walker frame. U.S. Pat. No. 3,195,550 discloses a walking device having crutch support surfaces fitting snugly into the armpits of the individual. U.S. Design Pat. No. D181,957 discloses a walker design incorporating crutch-like supports, and U.S. Pat. No. 6,470,900 discloses a crutch with a stabilizer brace.

DISCLOSURE OF INVENTION

The present invention relates to a walker device support of unique character which provides arm alignment and stability of a patient's weak or immobilized arm in a specific manner allowing the patient to place weight onto her or his weaker arm through the hand. This can facilitate and stimulate muscle return and muscle re-education. The invention will allow a stroke patient to bear weight more symmetrically onto her or his weaker leg. This can help promote a more normal gait pattern, which is enhanced when working with a therapist, a trained care giver, or family member.

As will be seen in greater detail below, the support is in the nature of a separate assembly readily attachable to or detachable from an existing conventional walker. The support provides alignment and support of a person's forearm and hand onto the walker device.

The device has adjustment features that can accommodate slight changes of the angle of a patient's elbow and different patient physical sizes. The invention overcomes the deficiencies inherent in the prior art arrangements indicated above which do not allow weight to be transferred downwardly through the patient's arm and hand to the walker frame, such action having beneficial and salubrious effects for stroke patients and others.

The support of the present invention is utilized in combination with a walker device including a walker frame including an upper walker frame segment.

The support is connected to the walker frame and projects upwardly from the upper walker frame segment.

The support includes an elongated member connected to the walker frame and extending upwardly from the upper walker frame segment, the elongated member having an upper distal end. The support further includes a forearm cuff member connected to the elongated member at a location thereon elevated relative to the upper walker frame segment and projecting laterally and forwardly of the elongated member generally over the upper walker frame segment to provide support for the forearm of the user of the walker device limiting sideways movement of the forearm while maintaining the forearm in a generally vertical orientation enabling body weight to be applied downwardly through the forearm and base of the hand to the upper walker frame segment.

Other features, advantages and objects of the present invention will become apparent with reference to the following description and accompanying drawings.

BEST MODE FOR CARRYING OUT THE INVENTION

Figure 1:
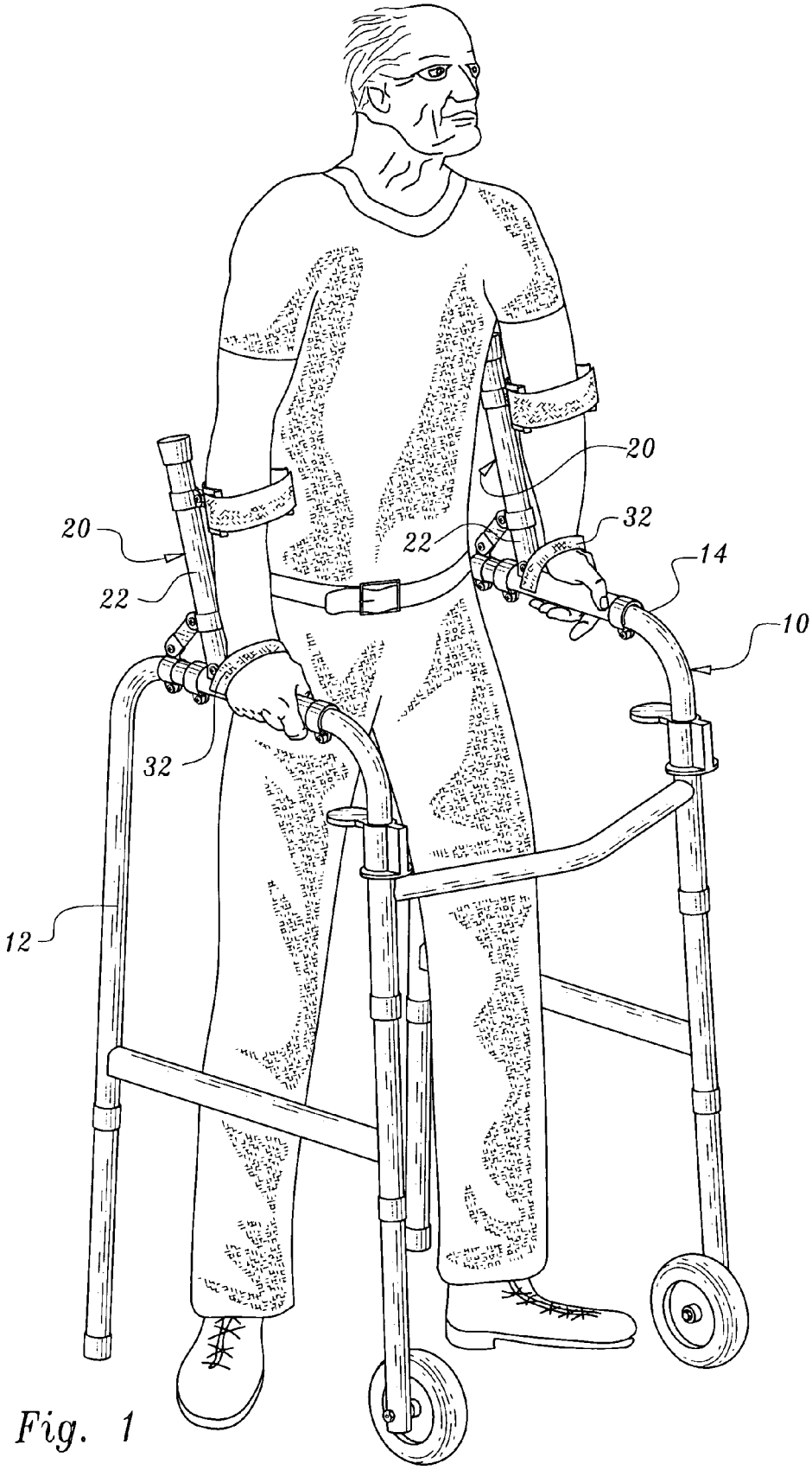
FIG. 1 is a frontal, perspective view of a patient utilizing a walker device and a pair of supports constructed in accordance with the teachings of the present invention connected to the walker frame.
Figure 2:
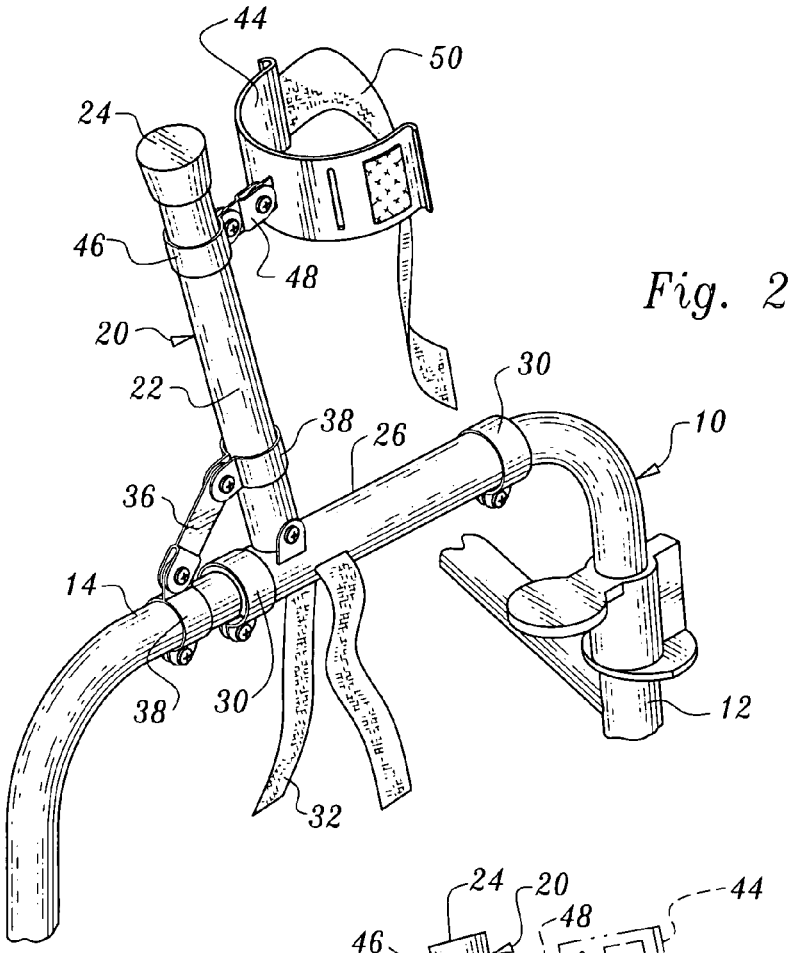
FIG. 2 is an enlarged, perspective view of a support connected to an upper walker frame segment of the walker.

Referring now to the drawings, a conventional invalid walker being utilized by a patient (illustrated in FIG. 1) is designated by reference numeral 10. Walker device 10 includes a walker frame 12 including two spaced, parallel upper walker frame segments 14. In normal usage the upper walker frame segments 14 are manually grasped directly by the user of the walker device to transfer body weight thereto. If the user's arm or arms are physically impaired an arm support may be necessary.

The support of the present invention is designated by reference numeral 20, there being two such supports 20 shown in FIG. 1, one connected to each of the upper walker frame segments. The supports 20 are identical in construction. These supports align and stabilize the user's arms. Although two supports are shown, in certain circumstances, only one support may be required.

Each support 20 is connected to the walker frame and each projects upwardly from the associated upper walker frame segment 14. Support 20 includes a tubular-shaped, elongated member 22 connected to and extending upwardly from an upper walker frame segment. The elongated member 22 has an upper distal end 24, which may be capped as shown.

The support 20 additionally includes a support base 26 which in the arrangement illustrated is in the form of a partial sleeve 28 positioned over an upper walker frame segment and releasably secured thereto at a desired location by clamps 30. The base or sleeve 28 is in the nature of a hand-grip. A hand stabilizing strap 32 is utilized to secure the patient's hand in place, if required.

Figure 3:
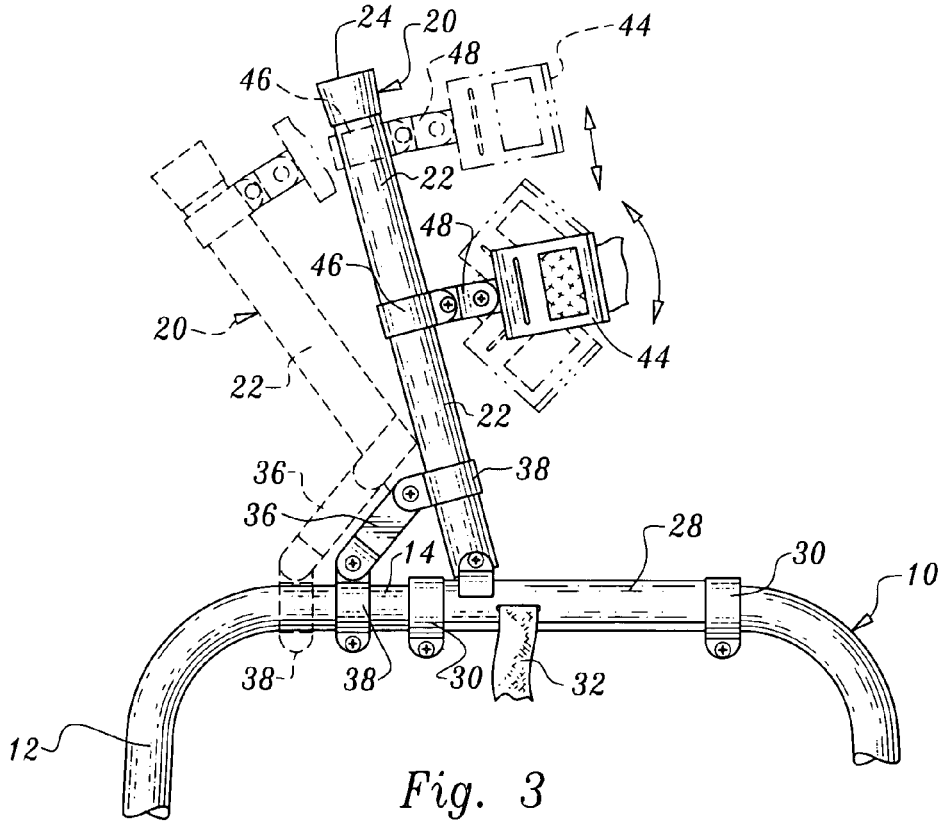
FIG. 3 is a side, elevational view of the support on the upper walker frame segment and illustrating with solid and dash lines representative alternative positions of support components.

The bottom of the elongated member 22 is pivotally connected to the support base for adjusting the angle between the elongated member and the associated upper walker frame segment. FIG. 3 shows the elongated member 22 in two alternative positions, one illustrated by solid lines and the other by dash lines.

Lock structure is provided for selectively locking the elongated member against pivotal movement relative to the support base to maintain the elongated member and the associated upper walker frame segment at a selected angle relative to one another.

More particularly, the lock structure includes a lock arm 36 and two securement members 38 in the form of clamps pivotally connected at opposed ends of the lock arm. One of the securement members or clamps 38 is adjustably mounted on the elongated member 22 and the other of the securement members or clamps 38 is adjustably mounted on the upper walker frame segment 14, as shown.

The support 20 also includes a forearm cuff member 44 which is connected to the elongated member by a clamp 46 and a pivot connector 48. The forearm cuff member is at a location on the elongated member elevated relative to the upper walker frame segment. The forearm cuff member projects laterally and forwardly of the elongated member generally over the upper walker frame segment to provide support for a forearm of a user.

The nature of such support differs dramatically from those of the prior art indicated above. The support 20 limits sideways movement of the forearm while maintaining the forearm in a generally vertical orientation, enabling body weight to be applied downwardly through the forearm and hand to the upper walker frame segment. The term generally vertical as employed herein means that the forearm cuff member is oriented and positioned to maintain the forearm less than about 45 degrees relative to vertical. The structure is adjustable to maintain such orientation regardless of the size and other physical characteristics of the walker user.

As can best be seen with reference to FIG. 3, the clamp 46 may be loosened and slid along the elongated member. The forearm cuff member 44 is pivotally attached to the elongated member by clamp 46. These motions are represented by the two double-headed arrows in FIG. 3. Once the correct position is established for a patient's arm, the forearm cuff member will be locked against linear and movement relative to elongated member 22 and the elongated member is locked at the desired inclination.

A forearm cuff member 44 is curved to define a concavity for receiving the patient's forearm and a forearm support strap 50 is employed to maintain the forearm in the recess, providing the desired lateral support and orientation. The pivotal attachment of the forearm cuff member 44 to clamp 46 allows the forearm cuff member to be angularly adjusted for proper positioning relative to the user's forearm. Such an arrangement aligns and stabilizes the patient's weak or immobilized arm, allowing the patient to place weight onto the weaker arm and hand, which facilitates and stimulates muscle return and muscle re-education. Such an arrangement will also allow a stroke patient to bear weight more symmetrically onto her or his weaker leg. This can help promote a more normal gait pattern, which is enhanced when working with a therapist, a trained care giver, or family member.

The invention claimed is:

1. In combination:

a walker device for use by an individual having an arm including a forearm and a hand, said walker device including a walker frame including a generally horizontal upper walker frame segment; and a support comprising a unitary assembly releasably connected to the walker frame and projecting upwardly from the upper walker frame segment, said support intended for stabilizing the arm of an individual using the walker by maintaining the arm straight and said forearm and hand in desired positions relative to said walker device, said support including an elongated member connected to and extending upwardly from said generally horizontal upper walker frame segment and disposed over said generally horizontal upper walker frame segment, said elongated member having an upper distal end, and said support further including a forearm cuff member connected to said elongated member at a location thereon elevated relative to said generally horizontal upper walker frame segment and projecting laterally and forwardly of said elongated member over said upper walker frame segment and a forearm support strap connected to said forearm cuff member, said forearm cuff member and said forearm support strap selectively adjustable up or down on said elongated member, said forearm cuff member defining a generally vertically oriented concavity intended for receiving a forearm of an individual using the walker device to provide support therefor and cooperable with said forearm support strap to maintain the arm of the individual substantially straight and in a generally vertical orientation directly above said generally horizontal upper walker frame segment and above the individual's hand and substantially preventing both sideways and back and forward movement of the forearm while allowing body weight to be applied downwardly through the arm and hand past the forearm cuff member and forearm support strap to the generally horizontal upper walker frame segment, said support additionally including a support base releasably attached to said generally horizontal upper walker frame segment, said elongated member connected to said support base and extending upwardly therefrom, and said support base including a hand-grip releasably connected to and extending along and at least partially surrounding said generally horizontal upper walker frame segment and a hand stabilizing strap connected to said hand-grip, said hand-grip being adjustably movable along said generally horizontal upper walker frame segment, said support additionally including a pivot connector for pivotally connecting said elongated member to said support base and to said walker frame and lock structure for selectively locking said elongated member against pivotal movement relative to said support base and to said walker frame to maintain said elongated member directly above said generally horizontal upper walker frame segment at a selected angle relative to said generally horizontal upper walker frame segment.

2. The combination according to claim 1 wherein said forearm cuff member is angularly adjustable relative to said elongated member.

3. The combination according to claim 1 wherein said lock structure includes a lock arm and two securement members, one of said securement members being adjustably mounted on said elongated member and the other of said securement members adjustably mounted on said generally horizontal upper walker frame segment.

* * * * *